US008632285B2

(12) United States Patent
Derler et al.

(10) Patent No.: US 8,632,285 B2
(45) Date of Patent: Jan. 21, 2014

(54) ROUTER TABLE CLAMP SYSTEM AND ROUTER TABLE INCLUDING THE CLAMP SYSTEM

(75) Inventors: John Charles Derler, Chicago, IL (US); Creighton Wade Nachtigall, Chicago, IL (US); Hagen Walter Dost, Chicago, IL (US); Juan Javier Ibarra Sandoval, Schaumburg, IL (US); Patrick Michael McAuliffe, Chicago, IL (US); Bobby Brent Boyd, Schaumburg, IL (US)

(73) Assignee: Robert Bosch GmbH, Stuttgart (DE)

( * ) Notice: Subject to any disclaimer, the term of this patent is extended or adjusted under 35 U.S.C. 154(b) by 982 days.

(21) Appl. No.: 12/724,127

(22) Filed: Mar. 15, 2010

(65) Prior Publication Data

US 2011/0222981 A1 Sep. 15, 2011

(51) Int. Cl.
*B27C 5/10* (2006.01)

(52) U.S. Cl.
USPC ..... 409/230

(58) Field of Classification Search
USPC ..... 409/229, 230, 182; 144/135.2, 286.1, 144/134.9, 286.5
See application file for complete search history.

(56) References Cited

U.S. PATENT DOCUMENTS

| | | | |
|---|---|---|---|
| 5,117,879 | A | 6/1992 | Payne |
| 5,715,880 | A | 2/1998 | Tucker et al. |
| 5,975,513 | A | 11/1999 | Wolfe |
| 7,066,695 | B1 | 6/2006 | Nuss |

OTHER PUBLICATIONS

Lee Valley & Veritas Catalog, Sep. 2009, pp. 1 and 178-180.

*Primary Examiner* — John C Hong
(74) *Attorney, Agent, or Firm* — Maginot, Moore & Beck

(57) ABSTRACT

A router table clamp system for attaching a router to a router table, wherein the system includes a first plate that is fixed with respect to the router table, a second plate that is configured to cooperate with the first plate to enable the router to be removably attached to the router table, and a clamping mechanism configured and arranged to move the second plate with respect to the first plate between a locked position and an unlocked position, wherein when the clamping mechanism is in the locked position, the router is securely attached to the router table. The clamping mechanism also includes a lever assembly configured and arranged to move the second plate in a locking direction and an unlocking direction, which directions are both generally coincident with a plane defined by the second plate, wherein the locking direction is opposite of the unlocking direction.

15 Claims, 7 Drawing Sheets

ROUTER TABLE CLAMP SYSTEM AND ROUTER TABLE INCLUDING THE CLAMP SYSTEM

The present invention relates generally to a system for attaching a power tool to an associated table or stand, and more particularly to a system for attaching a router to a router table.

BACKGROUND OF THE INVENTION

A variety of table-based power tools are known in the art. Such tools may be used, for example, to cut, shape or finish wood or other materials. One example of such a power tool is a router. One known configuration includes a router table that has a top working surface and a lower, or bottom, surface upon which is mounted a portable electric router. A common way of attaching the router to the underside of the table is to use a plurality of screws, bolts or other hardware parts. One of the drawbacks of such a mounting system is that it requires the user to hold and position the router while simultaneously inserting and tightening the screws or bolts (or otherwise positioning the attachment hardware parts) with a screwdriver, wrench or other tightening tool. Managing the holding/positioning process and the tightening process simultaneously by a single user can be very difficult. Moreover, such processes need to be performed each time the user removes the router, as well as each time that the router is re-installed to the table or to another machine or workbench.

BRIEF SUMMARY OF THE INVENTION

One of the benefits of embodiments of the present clamp system is that it provides a simple way for user to install a router (or other power tool) to a table or other device, and to easily remove the router (or other power tool) from the table or other device. Embodiments of the present clamp system enable a single user to perform the installation and/or removal of a router (power tool) without the need for a second user.

In particular, embodiments of the present router table clamp system can be used for attaching a router to a router table. Certain embodiments of the system preferably include a first plate that is fixed with respect to the router table, a second plate that is configured to cooperate with the first plate to enable the router to be removably attached to the router table, and a clamping mechanism. The clamping mechanism is preferably configured and arranged to move the second plate with respect to the first plate between a locked position and an unlocked position. When the clamping mechanism is in the locked position, the router is securely attached to the router table.

In certain embodiments, the clamping mechanism of the system includes a lever assembly that is configured and arranged to move the second plate in a locking direction and an unlocking direction. Preferably, the locking and unlocking directions are both generally coincident with a plane defined by the second plate. In addition, the locking direction is preferably opposite of the unlocking direction.

In some of the embodiments of the present clamp system, the first plate and the second plate are stacked one upon the other in a nested formation. However, in other embodiments, the first and second plates are arranged adjacent to each other so that they are both contained within the same horizontal plane.

Although the examples provided below and the majority of the description of the present clamp system relate to the system being used for attaching a router to the underside of a router table, it is also contemplated that the present system could also be used to attach other tools, such as power woodworking tools, to a table or workbench or other surface.

BRIEF DESCRIPTION OF THE SEVERAL VIEWS OF THE DRAWINGS

Preferred embodiments of the present invention are described herein with reference to the drawings wherein.

DETAILED DESCRIPTION OF THE INVENTION

Figure 1:
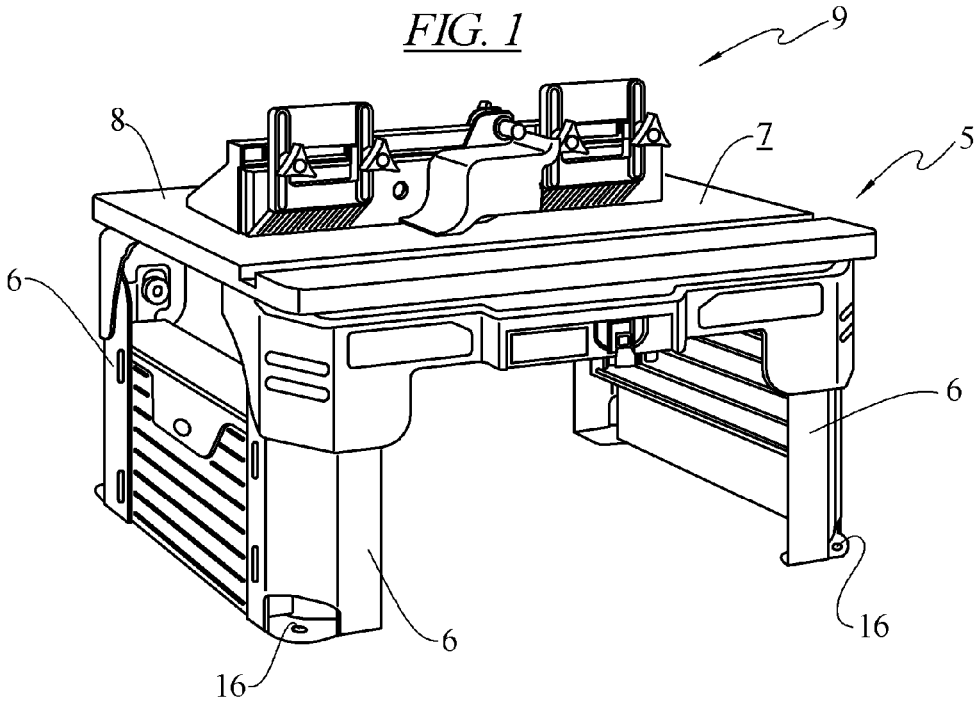
FIG. 1 is a front perspective view of a router table.
Figure 2:
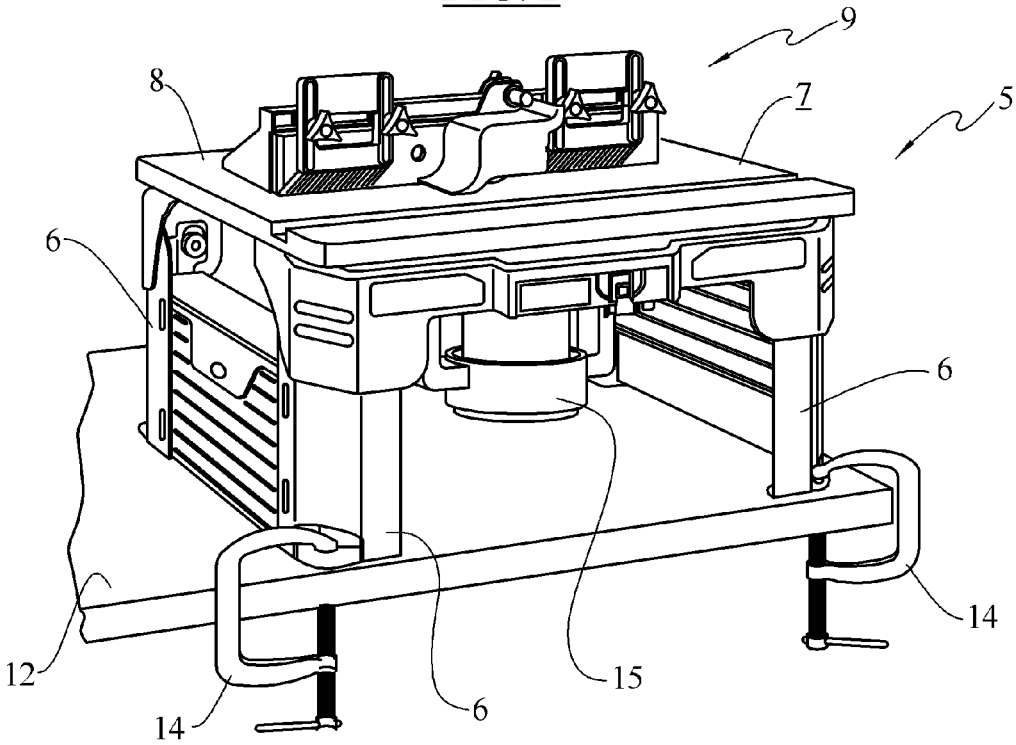
FIG. 2 is a front perspective view of the router table of FIG. 1, shown with a router attached thereto, and also shown attached to a workbench.

Turning now to the figures, embodiments of the present invention will be shown and described. One example of a router table, designated as table 5, is shown in FIGS. 1 and 2. A first embodiment of the present clamp system for use with such a router table, designated as clamp system 10, is shown in FIGS. 3-8. A second embodiment of the present clamp system for use with the same table, designated as clamp system 100, is shown in FIGS. 9-12.

More specifically, router table 5 of FIG. 1 is one example of the type of table that may be used with the present clamp system. Of course, other router tables, or other types of tables or workbenches associated with different tools, may also be used with the present clamp system. Router table 5 of this example includes a plurality of legs 6 that support a horizontally extending tabletop member 7, which includes a work surface 9 defined as the upper surface of the tabletop member 7. Router table 5 also includes components typically associated with a router table, such as a guide fence assembly 9.

Turning now to FIG. 2, router table 5 is shown with a router 15 attached to the underside of tabletop member 7. In the FIG. 2 view, the router table 5 is shown clamped to a workbench 12 through the use of a plurality of C-clamps 14. Other methods of securing the router table 5 to a stable surface, such as workbench 12, are also contemplated, such as by screwing the router table 5 directly into the workbench using screws inserted into mounting holes 16 (shown in FIG. 1) at the bases of the legs 6. Although the example router table 5 is a portable table, it is also contemplated that the present router clamp system, described below, could also be used with a larger scale table, which would not need to be mounted to a workbench.

Figure 3:
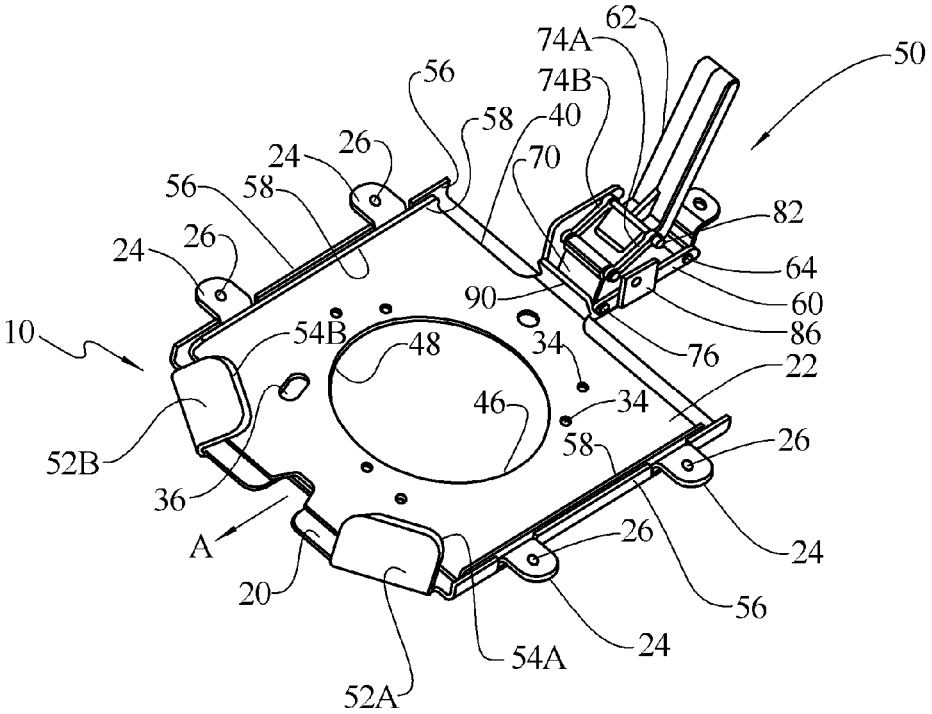
FIG. 3 is a perspective view of several components of one embodiment of the present router table clamp system.
Figure 4:
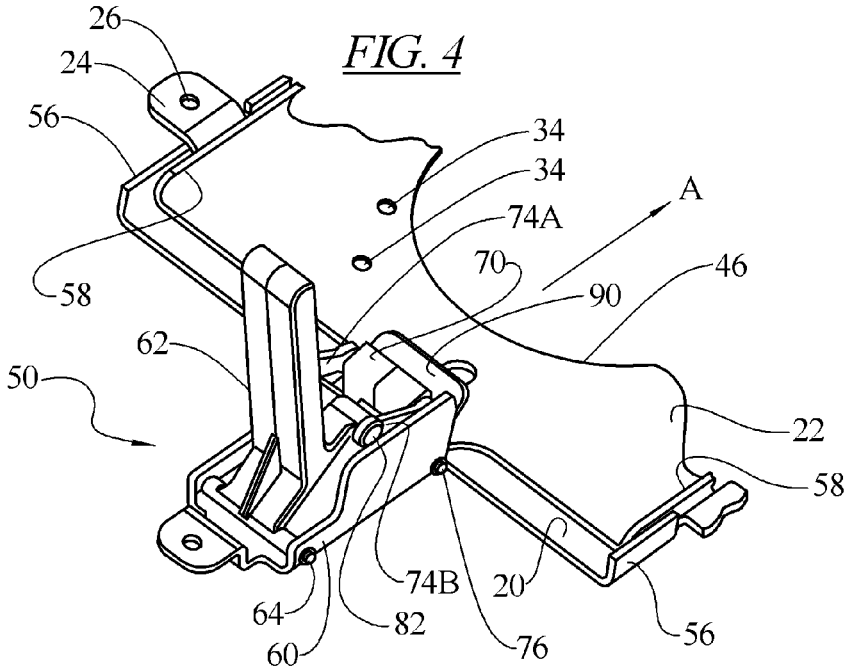
FIG. 4 is an enlarged view of a portion of the router table clamp system of FIG. 3.

Turning now to FIGS. 3-8, a first embodiment of the present table clamp system is shown and will be described. FIG. 3 shows a perspective view of clamp system 10 from an underside thereof, and FIG. 4 shows an enlarged view of the clamping mechanism of the present table clamp system 10.

More specifically, this embodiment preferably includes two main plates—a first plate 20 and a second plate 22, where the first plate 20 is shown in FIGS. 3 and 4 positioned below the second plate 22. The first plate 20, which may also be referred to as a backing plate, is configured to be fixed to the underside of the tabletop member 7 (FIG. 1) of the router table. Thus, in operation, the table clamp system 10 of FIG. 3 would be positioned in an inverted manner to the way it is shown in FIG. 3 (i.e., when installed to the underside of the tabletop member, the first plate 20 would be located above the second plate 22).

Figure 8:
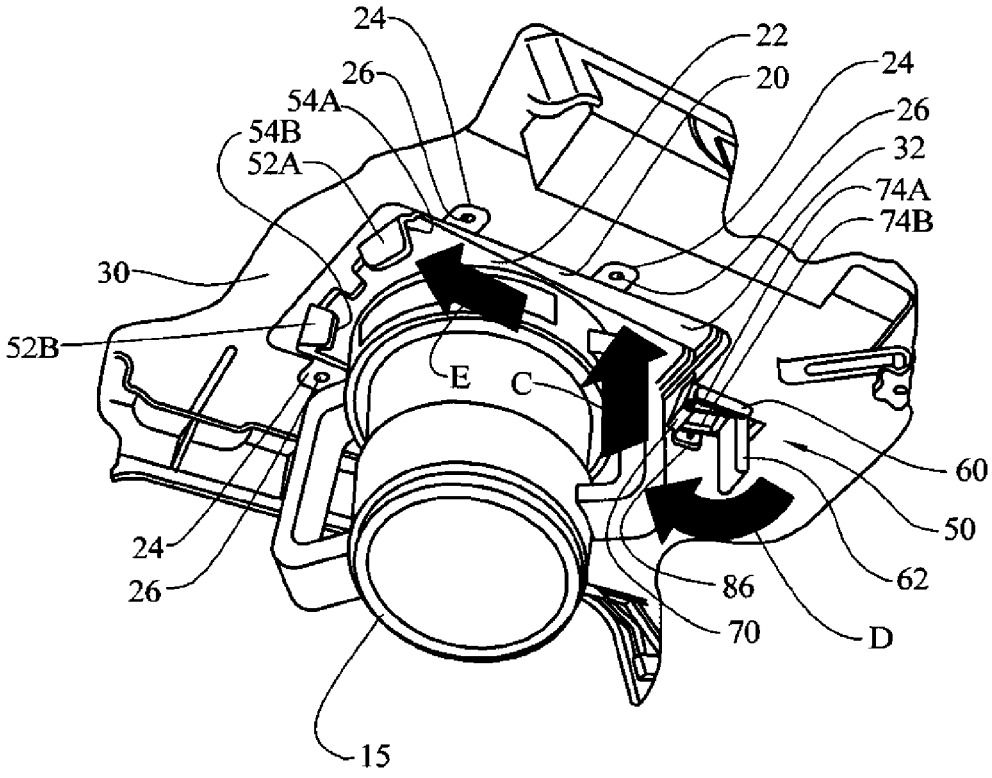
FIG. 8 is a bottom perspective view of the router table of FIGS. 1 and 2 showing the router being attached thereto using the clamp system of the embodiment of FIGS. 3-7.

In the preferred configuration of this embodiment, the first plate 20 includes a plurality of ears 24 that extend from the side edges of the first plate 20, and each of the ears 24 includes at least one mounting aperture 26, which is configured to receive a fastener such as a screw (not shown) for attaching the first plate 20 to the bottom surface 30 of the tabletop member, such as shown in FIG. 8. As also shown in FIG. 8, the bottom surface 30 of the tabletop member may also include a recessed portion 32, which allows for more secure and accurate attachment of the first plate 20 to the underside 30 of the tabletop member. Of course, it is also contemplated that the recessed portion could be omitted, and that the first plate could be attached to the table by other means than that shown and described.

Figure 6:
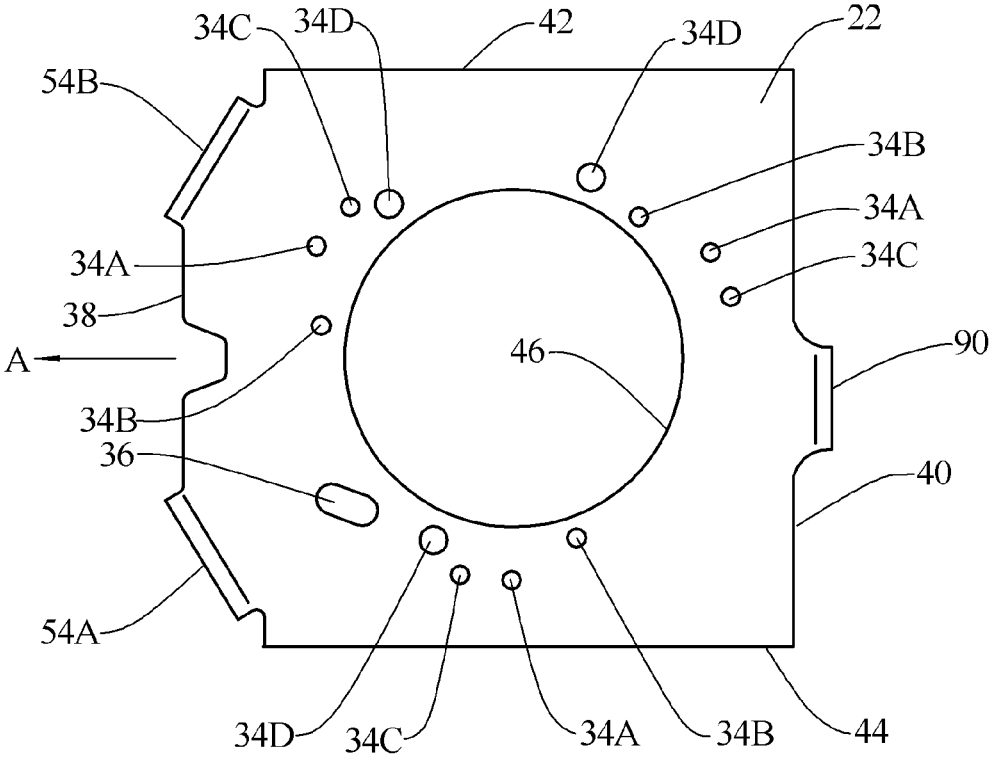
FIG. 6 is a plan view of a plate of the FIG. 3 embodiment of the present clamp system.
Figure 7:
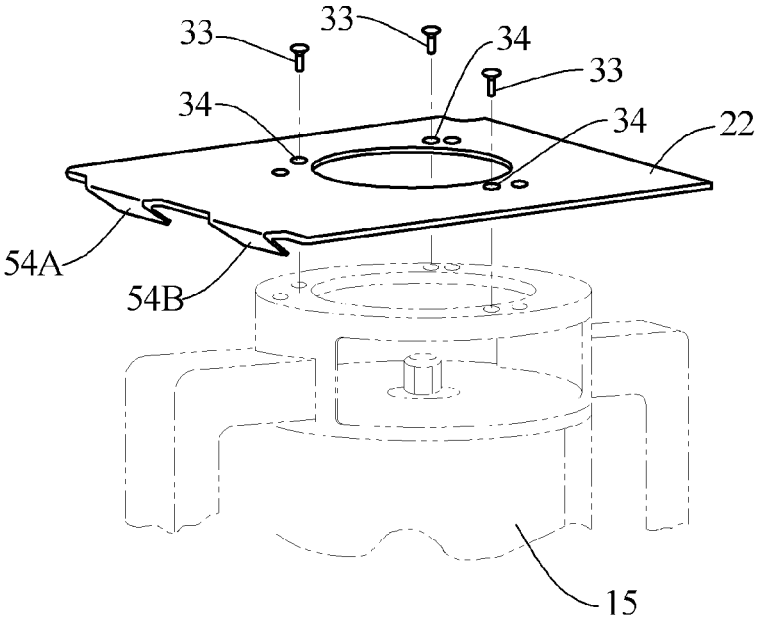
FIG. 7 is an exploded perspective view showing how the plate of FIG. 6 is attached to a router.

The second plate 22, which may also be referred to as the mounting plate, is configured to be mounted to the router 15 via a plurality of screws 33 (or other fasteners) that pass through holes 34, such as shown in FIG. 7. In the preferred embodiment, the second plate 22 is configured to receive different types of routers from different manufacturers, and thus, as shown in FIG. 6, the second plate 22 preferably includes a plurality of hole patterns, such as hole pattern 34A, hole pattern 34B, hole pattern 34C and hole pattern 34D, where each hole pattern includes a plurality of holes arranged to correspond to the hole configuration on the bottom of a particular router. Optionally, the second plate may also include one or more additional holes, such as access hole 36, which provides access to a router adjustment feature, such as an over table height adjustment feature found on certain models of routers.

The second plate 22 also includes a router aperture 46, as shown in FIG. 6, which is configured and arranged for allowing a router bit of the router 15 to extend therethrough. Similarly, the first plate 20 also includes a corresponding router aperture 48 that serves the same purpose.

As can be seen in FIG. 6, the second plate 22 of this embodiment includes a leading edge 38, when considered with respect to the movement direction represented by arrow A, which is the locking direction, as explained more fully below, and a trailing edge 40. This embodiment of the second plate 22 also includes a pair of side edges, designated as first side edge 42 and second side edge 44, that extend between the leading edge 38 and the trailing edge 40.

The first plate 20 and the second plate 22 of this embodiment are preferably made of metal, but other suitably rigid, strong materials may also be used.

Figure 5:
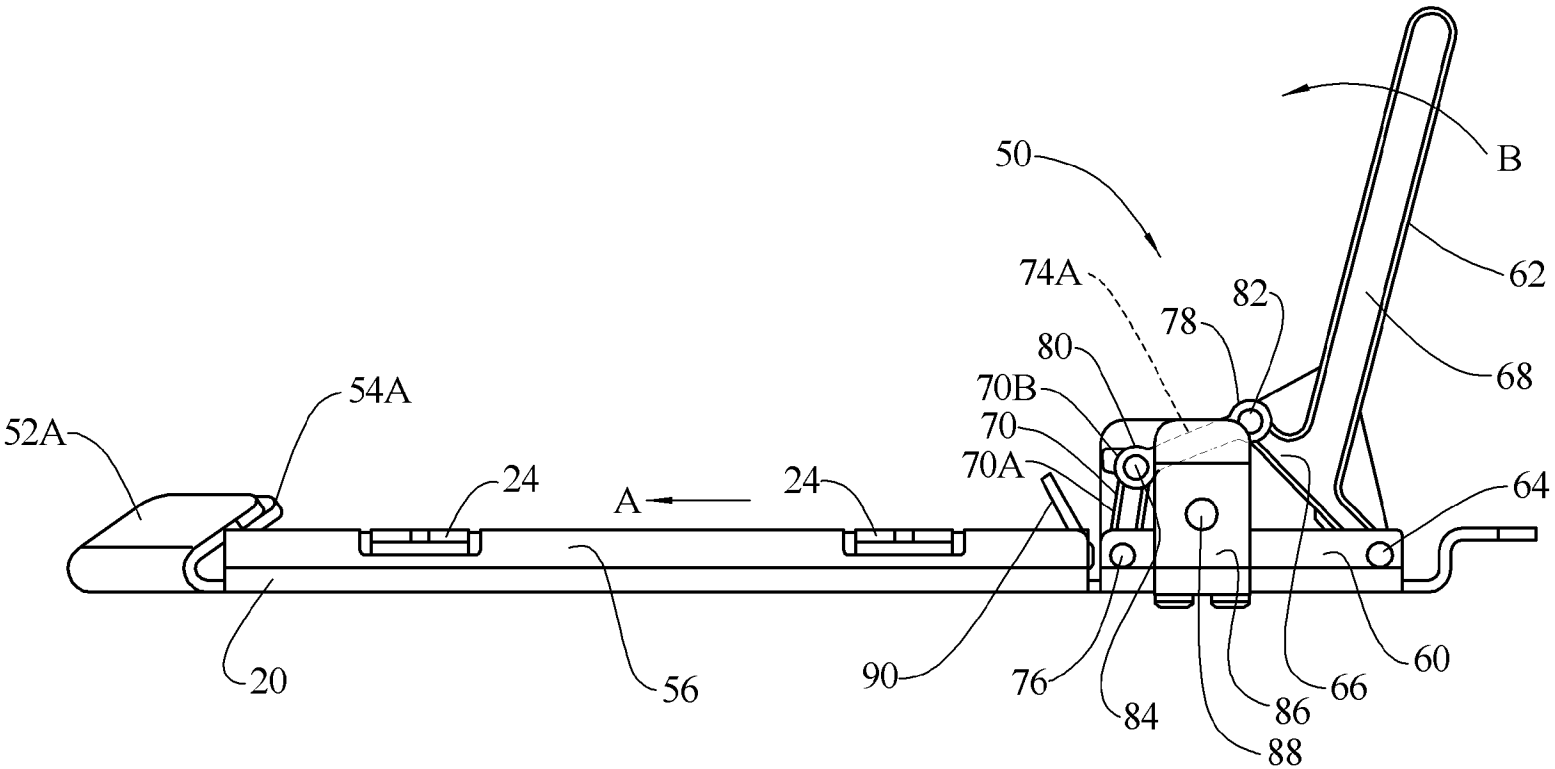
FIG. 5 is an enlarged side view of the components of the router table clamp system of FIG. 3.

The manner in which the first plate 20 interacts with the second plate 22 in this embodiment will be described next. In general, the first and second plates (20 and 22) are stacked upon each other, such as shown in FIGS. 3-5. Moreover, this embodiment includes a clamping mechanism 50 that is configured and arranged to move the second plate 22, with respect to the first plate 20, between a locked position and an unlocked position. When the clamping mechanism 50 is in the locked position, the router 15 is securely attached to the bottom surface 30 (FIG. 8) of the tabletop member of the router table because the router 15 is securely attached to the second plate 22 (via screws 33), the second plate 22 is securely attached to the first plate 20 (via the clamping mechanism 50), and the first plate 20 is securely attached to the bottom surface 30 of the tabletop member (via additional screws passing through mounting apertures 26).

Basically, the first plate 20 remains stationary, as it is attached to the bottom surface 30 of the tabletop member, and the second plate 22 is moved in the direction of arrow A by the clamping mechanism 50 until it is wedged into a locked position with respect to the first plate 20. More specifically, the first and second plates (20 and 22) include at least one set of corresponding tabs that nest together, such as the pair of leading edge tabs 52A, 52B on the first plate 20 and the pair of leading edge tabs 54A, 54B on the second plate 22. The embodiment of FIGS. 3-8 includes two sets of corresponding leading edge tabs (52A/54A and 52B/54B), but it is contemplated that the table clamping system 10 could operate with a single set of corresponding, nested tabs (preferably centered along the leading edges of the first and second plates) or with three or more sets of corresponding, nested tabs.

In the embodiment shown in FIGS. 3-8, the tabs (52A, 52B, 54A, 54B) are angled with respect to the locking direction A. More specifically, as can be seen in FIG. 6, the pair of leading edge tabs 54A, 54B extend from chamfered portions of the leading edge 38 of the second plate 22, whereby each of the leading edge tabs 54A, 54B extends sideways in an oblique manner with respect to the locking direction represented by arrow A. As can be seen in FIG. 3, in this embodiment, the pair of interlocking tabs 52A, 52B of the first plate 22 are aligned with the pair of leading edge tabs 54A, 54B of the second plate 22. Although the tabs in this embodiment are preferably angled in the manner shown in FIGS. 3 and 6, it is also contemplated that they could be angled differently, or that they could be arranged to be perpendicular with respect to locking direction A.

Optionally, the first plate 20 and the second plate 22 may each include a set of rims for maintaining the plates in proper alignment relative toe ach other. For example, FIGS. 3 and 4 show plates 20 and 22 with such optional rims, where the first plate 20 includes a first set of side rims 56 that extend along the side edges thereof, and the second plate 22 includes a second set of side rims 58 that extend along the side edges thereof. The first set of side rims 56 and the second set of side rims 58 cooperate to maintain the first plate 20 and the second plate 22 in alignment when the second plate 22 is moved in the locking and unlocking directions (i.e. in the arrow A direction and in the direction opposite of arrow A, respectively). Of course, it is contemplated that the side edges could be included on only the first plate 20, or that both sets of side edges could be omitted, especially if the table bottom 30 includes a recessed portion 32, as shown in FIG. 8, which recess would perform a similar alignment function.

Turning now to FIGS. 3-5, one example of the type of clamping mechanism 50 that may be used in this embodiment will be described. Basically, the clamping mechanism 50 includes a lever assembly that is configured and arranged to move the second plate 22 in either the locking direction (arrow A) or an unlocking direction (opposite of arrow A), which directions are both generally coincident with a plane defined by the second plate 22. As can be seen in FIG. 3, the clamping mechanism 50 is operatively attached to the router table at a location adjacent the trailing edge 40 of the second plate 22.

The lever assembly of the clamping mechanism 50 may be an over-center toggle clamp type of mechanism. For example, as shown in FIG. 8, the lever assembly of this embodiment may include a lever housing 60 that is fixed to bottom surface 30 of the router table 5. Preferably, the lever housing 60 is unitarily formed with the first plate 20, and thus when plate 20 is attached to the bottom of the rotor table, the lever housing also becomes attached. However, it is contemplated that the lever housing could be secured to the table with additional fasteners, such as with screws extending through apertures in the base of the lever housing. Additionally, it is also contemplated that the lever housing 60 could be a separate component from the first plate 20, and therefore it would need to be separately attached to the bottom of the router table by any known method, such as with screws extending through apertures.

Referring to FIGS. 3-5 and 8, the lever assembly of this embodiment also includes a lever member 62, a clamp member 70, and a pair of link members 74A and 74B (where only link member 74A can be seen, in hidden lines, in FIG. 8). More specifically, the lever member 62 is rotatably connected to the lever housing 60 via a first pivot pin 64. In this embodiment, the lever member 62 is preferably a generally T-shaped member, as can be seen in FIG. 5 (in which the arm portion 66 of the T is preferably skewed with respect to the post portion 68 of the T). The clamp member 70, which in this embodiment may be a generally L-shaped member (as shown in FIG. 5, which shows base portion 70A and leg portion 70B), is rotatably connected to the lever housing 60 via a second pivot pin 76. Finally, the pair of link members (74A and 74B), which are each preferably formed of a generally linear member, each extend between a lever end 78 and a clamp end 80. Additionally, the lever end 78 of each link member is rotatably connected to the lever member 62 via a lever pin 82 and the clamp end 80 of each link member is rotatably connected to the clamp member 70 via a link pin 84.

The locking operation of the clamping mechanism 50 will be described next. FIG. 5 shows the clamping mechanism 50 in the unlocked position, whereby the lever member 62 is directed away from the plates 20 and 22. In order to move the clamping mechanism 50 into the locked position, the lever member 62 is moved in a direction coincident with arrow B. In this example, the lever member 62 is moved in direction B until the distal end of the lever member 62 is positioned above the link members 74A and 74B. Moving the lever member 62 in this manner causes link members 74A and 74B to move link pin 84 to move downward and generally toward the left, when considered with respect to the FIG. 5 view. Such movement of the link pin 84 causes the clamp member 70 to rotate in a counter-clockwise direction about the second pivot pin 76 (which is mounted to lever housing 60), thereby causing the leg portion 70B of the clamp member 70 to push a trailing edge tab 90 that projects from, and is integrally formed with, the second plate 22. In the FIG. 5 view, the trailing edge tab 90 extends generally upwardly from the second plate 22, but when the clamp system 10 is installed on the bottom 30 of the tabletop member, as in FIG. 8, the trailing edge tab 90 will extend generally downwardly from the trailing edge 40 (FIG. 6) of the second plate 22.

When the trailing edge tab 90 of second plate 22 is pressed in direction A, the second plate 22 slides in direction A. However, since the first plate 20 is attached to the bottom 30 of the tabletop member, the first plate 20 remains stationary (i.e., the second plate 22 slides in direction A with respect to the first plate 20). The sliding of the second plate 22 continues until the pair of interlocking tabs 52A and 52B of the first plate 22 wedge against the corresponding pair of leading edge tabs 54A and 54B of the second plate. Thus, the combination of the wedge action between tabs 52A/52B and tabs 54A/54B and the force applied by the clamping mechanism 50 serves to securely lock the second plate 22 (with router 15 attached thereto) in position on the underside of the associated table 5 or workbench.

Further, in this embodiment, the clamping mechanism 50 also preferably includes a retaining spring 86, or other mechanism, to securely retain the lever member 62 in the locked position. In the preferred embodiment, the retaining spring 86 also includes an aperture 88. The aperture 88 is configured to engage an extension of the lever pin 82 when the lever member 62 is in the locked position in order to reduce the likelihood that the lever member will unintentionally move into an unlocked position. Instead of recess 88, it is also contemplated that a recess in retaining spring 86 may be utilized to receive the lever pin extension. Of course, other alternative types of retaining mechanisms are also contemplated as being within the scope of the invention.

Turning now to FIG. 8, the method of installing the router 15 (which is already attached to second plate 22) to the bottom surface 30 of the tabletop member will be described. As can be seen in FIG. 8, the first plate 20 is already attached to the bottom surface 30 of the tabletop member. First, the assembly of the router 15 and the second plate 22 is moved upwardly, in the direction of arrow C, until the second plate 22 is in contact with the first plate 20. next, the lever member 62, which acts as a handle for the clamping mechanism 50, is rotated in the direction or arrow D until the clamping mechanism 50 is in its locked position (such as with the extension lever pin 82 seated within the aperture 88 of the retaining spring 86). Movement of the lever member 62 in this manner causes the second plate 22 (with router 15 attached thereto) to move in the direction of arrow E, which is referred to as the locking direction. The second plate 22 moves in direction E until leading edge tabs 54A and 54B of the second plate 22 interlock with the corresponding tabs (52A and 52B, respectively) of the first plate 20, at which point the clamping mechanism 50 will be in its locked position. Thus, in such a position, the router is securely attached to the router table.

Removal of the router from the table is also a simple process. The user simply reverses the steps outlined above. Specifically, the clamping mechanism 50 is unlocked by moving lever member 62 in the direction opposite of arrow B while simultaneously pulling retainer spring 86 slightly outwardly to allow for the lever pin 82 to become unseated from the aperture 88 in the retainer spring. Such unlocking of the lever mechanism 50 causes the second plate 22 (with router 15 attached thereto) to move in the direction opposite of arrow E (i.e., the unlocking direction), whereby the router 15 (with second plate 22 attached thereto) can be moved away from the table in the direction opposite of arrow C.

Turning now to FIGS. 9-12, a second embodiment will be described, which second embodiment will be designated as clamp system 100. The basic principals of this embodiment are similar to those of the first embodiment, such as enabling the user to easily attach and remove a router (or other tool) from a table by having two plates that slide relative to each other, where one plate is fixed to a bottom surface of the table. However, the configuration of the plates is somewhat different between embodiments.

In the second embodiment, there is a first plate 120 that is fixed with respect to the table, and a second plate 122 that is configured to cooperate with the first plate 120 to enable the router to be removably attached to the router table. The first plate 120 can be attached to the table bottom (such as bottom 30 of FIG. 8, which shows the first embodiment) by any desired means, such as by passing a plurality of screws (not shown) through a plurality of mounting apertures 126. Preferably, there are at least two mounting apertures 126, and they are each in the form of an elongated slot to allow for some positional adjustment.

The second plate 122 is configured to be able to move toward the base 18 of the router 15, thereby enabling the slidable second plate 122 to cooperate with the fixed first plate 120 to clamp the router 15 therebetween, which allows the router to be removably attached to the table.

Figure 9:
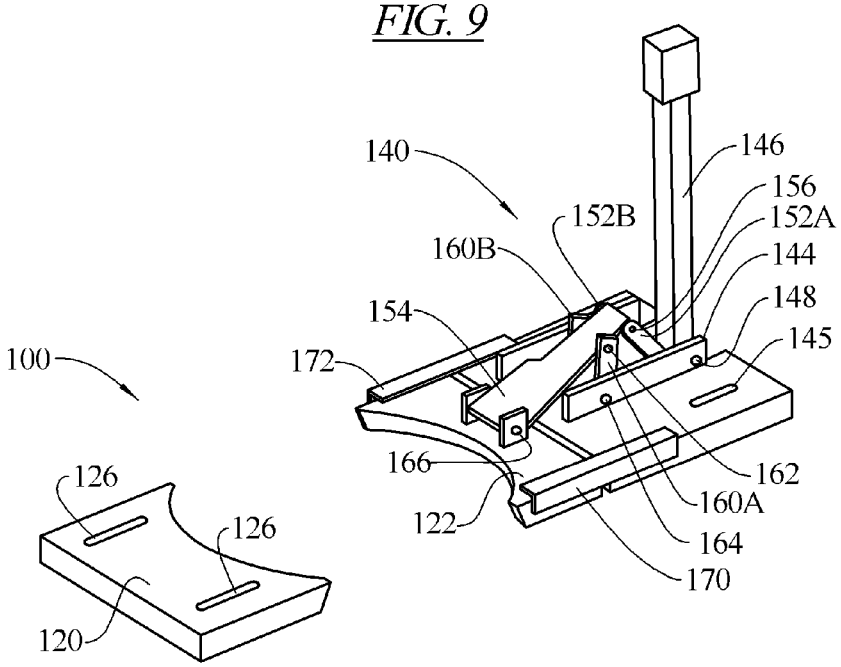
FIG. 9 is a bottom schematic perspective view (shown inverted) of several components of another embodiment of the present router table clamp system (shown without the router table, for clarity)

In order to secure the router base 18 to the plates 120 and 122 in a more stable manner, the plates are preferably beveled on the edges that contact the router base 18. Specifically, as can be seen in FIG. 9, the first plate 120 preferably includes a first beveled edge portion 130, which is preferably arc-shaped in plan view, and the second plate 122 also preferably includes a second beveled edge portion 132, which is also preferably arc-shaped in plan view. Even more specifically, since the router base 18 will most likely be circular, the first and second beveled edge portions (130 and 132) are each preferably semi-circle shaped in plan view. Of course, if the router base is of a different shape, the edge portions will be of a shape that corresponds to the shape of the router base. Thus, in the preferred form of this embodiment, the first beveled edge portion 130 and the second beveled edge portion 132 are configured and arranged to cooperate with each other to attach the router 15 to the router table by sandwiching the router between the first and second beveled edge portions.

In this embodiment, the first and second plates (120 and 122) may be formed of a compressible material, such as natural or synthetic rubber. Alternatively, the plates 120 and 122 may be formed of any desired material, such as metal, with only the first and second beveled edge portions (130 and 132) being formed of a compressible material such as natural or synthetic rubber.

Figure 10:
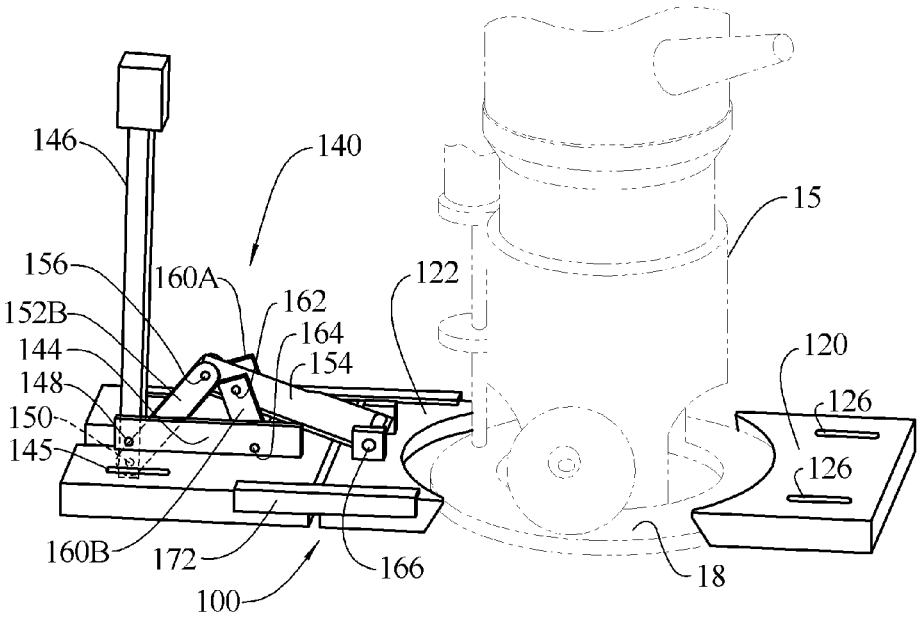
FIG. 10 is a bottom schematic perspective view (shown inverted) of the router table clamp system of FIG. 9, shown with a router being clamped therein (shown without the router table, for clarity)
Figure 11:
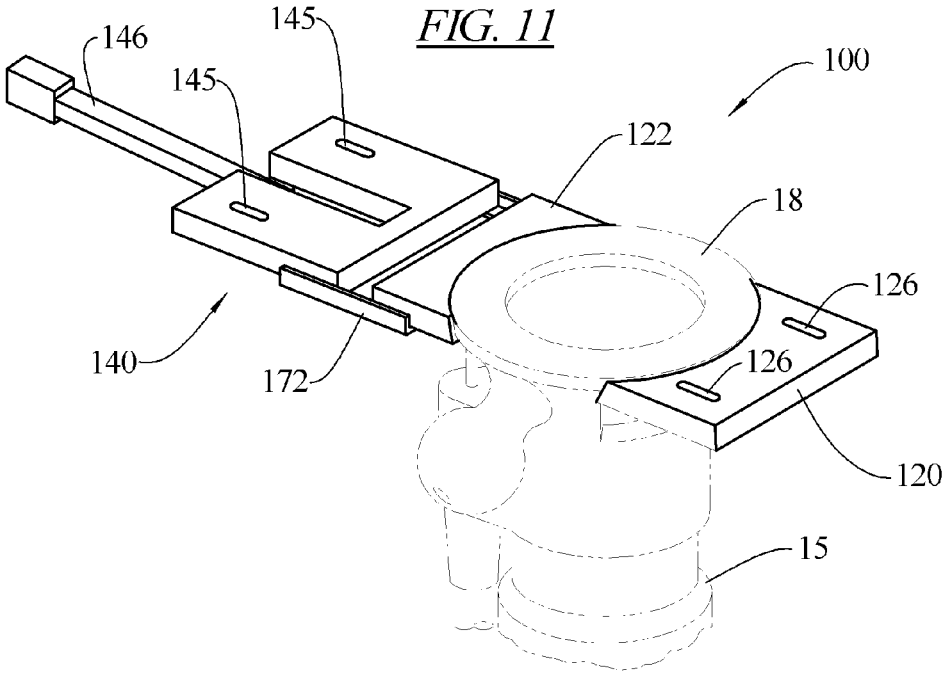
FIG. 11 is a top schematic perspective view the router table clamp system of FIG. 9, shown in a locked position (shown without the router table, for clarity)

The second embodiment of FIGS. 9-12 includes a clamping mechanism 140, which is configured and arranged to move the second plate 122 with respect to the first plate 120 between a locked position, such as shown in FIG. 11, and an unlocked position, such as shown in FIG. 10. When the clamping mechanism 140 is in the locked position, the router 15 is securely attached to the router table.

The clamping mechanism may be any desired type of mechanism that enables the second plate 122 to move the required distance in an essentially horizontal plane, and then locks the second plate 122 in that position. For example, the clamping mechanism may be an over-center toggle clamp.

The first embodiment of FIGS. 1-8 includes one example of a clamping mechanism 50 that could also be used in the second embodiment of FIGS. 9-12. Alternatively, the clamping mechanism 140 shown in FIGS. 9-12 could also be used. Details of the clamping mechanism 140 will be described next.

Figure 12:
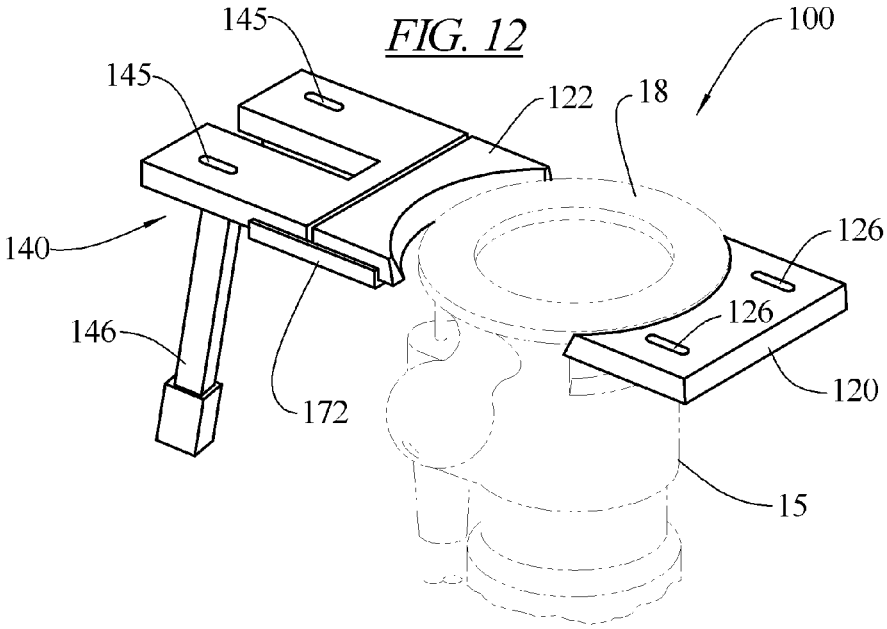
FIG. 12 is a top schematic perspective view of the router table clamp system of FIG. 9, shown in an unlocked position (shown without the router table, for clarity).

In general, the clamping mechanism 140 of this embodiment includes a lever assembly that is configured and arranged to move the second plate 122 in a locking direction (towards first plate 120) and an unlocking direction (away from first plate 120), which directions are both generally coincident with a plane defined by the second plate 122. FIGS. 9, 10 and 12 show the clamping mechanism 140 in the unlocked position, while FIG. 11 shows the clamping mechanism 140 in the locked position.

More specifically, as can be seen in FIGS. 9 and 10, the clamping mechanism includes a lever housing 144 that is fixed to the router table (such as by screws that extend through slots 145), and a lever member 146 that is rotatably connected to the lever housing 144 via a first pivot pin 148. The lever member 146 extends below the pivot point of the first pivot pin 148 and includes an aperture for rotatably receiving a lever pin 150 that connects a pair of first link members 152A/152B to the lever member 146. The opposite ends of the first link members 152A/152B are connected to one end of a clamp member 154 via a first link pin 156. The clamp member 154 is also rotatably connected to a pair of second link members 160A/160B via a second link pin 162 that extends through an aperture in the clamp member 154. The opposite ends of the second link members 160A/160B pivot about a pivot pin 162 that is pivotally connected to the lever housing 144. The opposite end of the clamp member 154 is rotatably connected to the second plate 122 via a pivot pin 166.

Accordingly, in operation, the clamping mechanism 140 is in the unlocked position, such as shown in FIGS. 9, 10 and 12, when the lever member 146 is approximately perpendicular to the plane of the first and second plates 120, 122. In contrast, when the lever member 146 is moved to the position shown in FIG. 11, the configuration of the first and second link members (152A/B and 160A/B) causes the second plate 122 to slide toward the router base 18, to thereby lock the base in place. As can be seen in FIGS. 9-12, the second plate 122 can be maintained in sliding contact with the router table bottom by a set of rails 170 and 172. Alternatively, any other desired means of allowing sliding contact between the second plate 120 and the router table bottom may be employed.

While various embodiments of the present invention have been shown and described, it should be understood that other modifications, substitutions and alternatives may be apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. A router table clamp system for attaching a router, having base, to a router table, including an underside, wherein the system comprises:

a first plate that is fixed with respect to the router table;

a second plate that is configured to cooperate with said first plate to enable the router to be removably attached to the router table;

a clamping mechanism configured and arranged to move said second plate with respect to said first plate between a locked position and an unlocked position, wherein when said clamping mechanism is in said locked position, the router is securely attached to the router table, wherein said clamping mechanism includes a lever assembly configured and arranged to move said second plate in a locking direction and an unlocking direction, which directions are both generally coincident with a plane defined by said second plate, and further wherein said locking direction is opposite of said unlocking direction, wherein said second plate includes an inclined portion, said inclined portion configured to engage said first plate during movement of said second plate in said locking direction, said inclined portion deviating from horizontal and vertical with respect to said plane defined by said second plate.

2. The router table clamp system according to claim 1, wherein:

said second plate includes a leading edge, when considered with respect to said locking direction, a trailing edge, when considered with respect to said locking direction, and first and second side edges extending between said leading and trailing edges, wherein said leading edge includes said inclined portion; and said clamping mechanism is operatively attached to the router table at a location adjacent said trailing edge of said second plate.

3. The router table clamp system according to claim 1, wherein said lever assembly is fixed to the underside of the router table and comprises an over-center toggle clamp, wherein said lever assembly includes a lever member rotatably adjustable to move said second plate in said locking direction and said unlocking direction said lever member extending from the underside of the router table in one of said locked position and said unlocked position.

4. The router table clamp assembly according to claim 1, further comprising a retainer spring for maintaining said lever assembly in the locked position.

5. The router table clamp assembly according to claim 1, further comprising:

a plurality of ears that extend from side edges of said first plate; and at least one mounting aperture in each of said ears, whereby said ears are configured and arranged to enable said first plate to be attached to a bottom surface of the underside of the router table.

6. The router table clamp system according to claim 1, wherein said first and second plates each include a router aperture therein, wherein said router apertures are configured and arranged for allowing a router bit of the router to extend therethrough.

7. A router table clamp system for attaching a router to a router table, wherein the system comprises:

a first plate that is fixed with respect to the router table;

a second plate that is configured to cooperate with said first plate to enable the router to be removably attached to the router table;

a clamping mechanism configured and arranged to move said second plate with respect to said first plate between a locked position and an unlocked position, wherein when said clamping mechanism is in said locked position, the router is securely attached to the router table, wherein said clamping mechanism includes a lever assembly configured and arranged to move said second plate in a locking direction and an unlocking direction, which directions are both generally coincident with a plane defined by said second plate, and further wherein said locking direction is opposite of said unlocking direction;

a lever housing that is fixed to the router table;

a lever member that is rotatably connected to the lever housing via a first pivot pin;

a clamp member that is rotatably connected to said lever housing via a second pivot pin; and a pair of link members each extending between a lever end and a clamp end, wherein said lever ends of said link members are rotatably connected to said lever member via a lever pin and said clamp ends of said link members are rotatably connected to said clamp member via a link pin.

8. The router table clamp system according to claim 7, wherein:

said lever member is a generally T-shaped member;

said link members are each a generally linear member; and said clamp member is a generally L-shaped member.

9. The router table clamp assembly according to claim 7, further comprising:

a retainer spring positioned adjacent said lever assembly, wherein said retainer spring includes an aperture configured and arranged to receiving said lever pin therein to maintain said lever assembly in the locked position.

10. A router table clamp system for attaching a router to a router table, wherein the system comprises:

a first plate that is fixed with respect to the router table;

a second plate that is configured to cooperate with said first plate to enable the router to be removably attached to the router table;

a clamping mechanism configured and arranged to move said second plate with respect to said first plate between a locked position and an unlocked position, wherein when said clamping mechanism is in said locked position, the router is securely attached to the router table, wherein said clamping mechanism includes a lever assembly configured and arranged to move said second plate in a locking direction and an unlocking direction which directions are both generally coincident with a plane defined by said second plate, and further wherein said locking direction is opposite of said unlocking direction, said second plate includes a leading edge, when considered with respect to said locking direction, a trailing edge, when considered with respect to said locking direction, and first and second side edges extending between said leading and trailing edges;

said second plate includes a trailing edge tab that extends generally downwardly from said trailing edge;

said second plate includes at least one leading edge tab that extends generally downwardly from said leading edge; and said first plate includes an interlocking tab that is positioned in a location that corresponds to said at least one leading edge tab of said second plate.

11. The router table clamp system according to claim 10, wherein:

a pair of said leading edge tabs are included on said second plate; and a pair of said interlocking tabs are included on said first plate.

12. The router table clamp assembly according to claim 11, wherein:

said pair of leading edge tabs extend from chamfered portions of said leading edge of said second plate, whereby each of said leading edge tabs of said pair of leading edge tabs extend sideways in an oblique manner with respect to said locking and unlocking directions; and said pair of interlocking tabs of said first plate are aligned with said pair of leading edge tabs.

13. The router table clamp assembly according to claim 10, further comprising;

a first set of side rims extending along said first and second side edges of said first plate; and a second set of side rims extending along side edges of said second plate, wherein said first set of side rims and said second set of side rims cooperate to maintain said first and second plates in alignment when said second plate is moved in said locking and unlocking directions.

14. A router table assembly comprising:

a router table;

a router;

a router table clamp system for attaching said router to said router table in an operative position, wherein said router table system includes:

a first plate that is stationarily fixed to said router table;

a second plate that is configured to cooperate with said first plate to enable said router to be removably attached to said router table;

a clamping mechanism configured and arranged to move said second plate with respect to said stationarily fixed first plate between a locked position and an unlocked position, wherein when said clamping mechanism is in said locked position, said router is securely attached to said router table, wherein said clamping mechanism includes a lever assembly configured and arranged to move said second plate in a locking direction and an unlocking direction with respect to said stationarily fixed first plate, which directions are both generally coincident with a plane defined by said second plate, and further wherein said locking direction is opposite of said unlocking direction, said second plate includes an inclined leading edge when considered with respect to said locking direction, a trailing edge, when considered with respect to said locking direction, and first and second side edges extending between said leading and trailing edges;

said clamping mechanism is operatively attached to an underside of said router table at a location adjacent said trailing edge of said second plate; and said lever assembly comprises an over-center toggle clamp.

15. A table clamp system for attaching a power tool to a table, wherein the system comprises:

a first plate that is stationarily fixed with respect to the table, said first plate including a first inclined edge;

a second plate including a second inclined edge that is configured to cooperate with said first inclined edge of said first plate to enable the power tool to be removably attached to the table;

a clamping mechanism configured and arranged to move said second plate with respect to said stationarily fixed first plate between a locked position and an unlocked position, wherein when said clamping mechanism is in said locked position, the power tool is securely attached to the table, wherein said clamping mechanism includes a lever assembly having a lever arm rotatably adjustable and configured and arranged to move said second plate in a locking direction and an unlocking direction, which directions are both generally coincident with a plane defined by said second plate, and further wherein said locking direction is opposite of said unlocking direction, wherein said second inclined edge moves towards said first inclined edge in the locking direction and said second inclined edge moves away from said first inclined edge in the unlocking direction.

* * * * *